US010662850B2

(12) United States Patent
Pavek

(10) Patent No.: US 10,662,850 B2
(45) Date of Patent: May 26, 2020

(54) COMPRESSION CLAMPING EXHAUST CATALYST

(71) Applicant: CompX International Inc., Greenville, SC (US)

(72) Inventor: Travis Pavek, Oshkosh, WI (US)

(73) Assignee: CompX International Inc., Greenville, SC (US)

( * ) Notice: Subject to any disclaimer, the term of this patent is extended or adjusted under 35 U.S.C. 154(b) by 0 days.

(21) Appl. No.: 16/505,928

(22) Filed: Jul. 9, 2019

(65) Prior Publication Data

US 2020/0018212 A1 Jan. 16, 2020

Related U.S. Application Data

(60) Provisional application No. 62/698,359, filed on Jul. 16, 2018.

(51) Int. Cl.

| | |
|---|---|
| ***F01N 3/28*** | (2006.01) |
| ***F01N 13/00*** | (2010.01) |
| ***F01N 13/18*** | (2010.01) |
| ***F01N 3/04*** | (2006.01) |

(52) U.S. Cl.

CPC ..... *F01N 3/2878* (2013.01); *F01N 3/043* (2013.01); *F01N 13/004* (2013.01); *F01N 13/1855* (2013.01); *F01N 2350/00* (2013.01); *F01N 2450/20* (2013.01); *F01N 2450/24* (2013.01)

(58) Field of Classification Search

CPC ..... F01N 3/043; F01N 3/2878; F01N 13/004; F01N 13/1855; F01N 2350/00; F01N 2450/20; F01N 2450/24

USPC ..... 422/177, 180; 52/523; 29/890

See application file for complete search history.

(56) References Cited

U.S. PATENT DOCUMENTS

| | | | | |
|---|---|---|---|---|
| 7,013,565 | B1 * | 3/2006 | Zelinski | F01N 3/046 29/890.038 |
| 7,552,586 | B1 * | 6/2009 | White | F01N 3/08 440/89 B |
| 7,827,690 | B1 * | 11/2010 | Zelinski | F01N 3/046 29/890.038 |
| 7,913,809 | B2 | 3/2011 | Zelinski | |
| 8,056,673 | B2 | 11/2011 | Zelinski | |
| 8,568,661 | B2 * | 10/2013 | Werni | F01N 3/035 422/177 |
| 8,763,375 | B2 * | 7/2014 | Wieland | F01N 13/1827 60/297 |
| 9,644,514 | B1 * | 5/2017 | Langenfeld | F01N 3/10 |
| 2006/0053779 | A1 * | 3/2006 | Belisle | F01N 3/0211 60/299 |

(Continued)

*Primary Examiner* — Tom P Duong

(74) *Attorney, Agent, or Firm* — Dority & Manning, P.A.

(57) ABSTRACT

Disclosed are apparatus and corresponding methodology for a compression clamped exhaust catalyst which is incorporated into a marine exhaust header. A serviceable exhaust catalyst is compression clamped and sealed inside an enclosure associated with a marine exhaust system while still maintaining serviceability. The catalyst is seated on an inset bead or ring on the inside of the enclosure. A ring cooperates with the enclosure to clamp a mating exhaust pipe, with a gasket situated between the two. Other structures are provided to compress the catalyst in the enclosure as it is sealed. As seated, the exhaust catalyst is held into place with a compression fit to limit its longitudinal movement while still remaining accessible for servicing.

25 Claims, 4 Drawing Sheets

(56) References Cited

U.S. PATENT DOCUMENTS

| | | | | |
|---|---|---|---|---|
| 2006/0191247 | A1* | 8/2006 | Thaler | B01D 46/0013 55/523 |
| 2010/0229540 | A1* | 9/2010 | Waggoner | F01N 3/046 60/298 |
| 2011/0074150 | A1* | 3/2011 | Drost | F01N 13/1811 285/363 |

* cited by examiner

COMPRESSION CLAMPING EXHAUST CATALYST

PRIORITY CLAIM

This application claims the benefit of previously filed U.S. Provisional Patent Application entitled "COMPRESSION CLAMPING EXHAUST CATALYST," assigned U.S. Ser. No. 62/698,359, filed Jul. 16, 2018, and which is incorporated herein by reference for all purposes.

FIELD OF THE SUBJECT MATTER

The presently disclosed subject matter generally relates to exhaust systems using catalysts and more particularly to compression clamping and sealing an exhaust catalyst inside an enclosure while still maintaining serviceability.

BACKGROUND OF THE SUBJECT MATTER

Various types of exhaust systems for use in marine applications (such as associated with engines used on a boat or similar) are generally known, the details of which form no particular part of the presently disclosed subject matter. See, for example, U.S. Pat. No. 8,056,673 entitled "Sound Dampening and Wear Protecting Flapper Configuration for Marine Exhaust System" and U.S. Pat. No. 7,913,809 entitled "Flapper Configuration for Marine Exhaust System." Both such patents are commonly owned with the present application, and their disclosures are fully incorporated herein by reference, and for all purposes.

In certain applications it is desirable to provide a serviceable catalyst which is sealed. Further, in some such circumstances, it is desirable to limit the amount of longitudinal movement of the catalyst in an associated enclosure.

While various implementations of exhaust systems have been developed, no design has emerged that generally encompasses all of the desired characteristics as hereafter presented in accordance with the presently disclosed technology.

SUMMARY OF THE SUBJECT MATTER

In view of the recognized features encountered in the prior art and addressed by the presently disclosed subject matter, improved apparatus and corresponding methodology therefor have been provided for improved exhaust systems. More particularly, the presently disclosed subject matter relates to the use of serviceable catalyst devices for use in marine exhaust systems.

One presently disclosed exemplary embodiment relates to a compression clamped exhaust catalyst which is incorporated into a marine exhaust header system. More particularly, in some presently disclosed embodiments, a serviceable exhaust catalyst is compression clamped and sealed inside an enclosure associated with a marine exhaust system while still maintaining serviceability.

Per some presently disclosed exemplary embodiments, the catalyst may be seated on an inset bead or ring on the inside of the enclosure. A ring cooperates with the enclosure to clamp a mating exhaust pipe, with a gasket situated between the two. Other structures may be provided to compress the catalyst in the enclosure as it is sealed. As seated, the serviceable exhaust catalyst may be held into place with a compression fit to limit its longitudinal movement while still remaining accessible for servicing.

One exemplary embodiment of presently disclosed subject matter relates to a compression mount apparatus for an exhaust catalyst for a marine header. Such mount apparatus preferably comprises in pertinent part an enclosure, inset bead, catalyst, ring, and clamping ring. More particularly, such mount apparatus preferably comprises a cylindrical enclosure having a pair of respective opposing open ends on opposite longitudinal ends thereof, for respective engagement with a marine header assembly and an exhaust pipe; a circular inset bead formed within one open end on such enclosure, and having a smaller radius than such one open end, with such one open end adapted for engaging with a junction component of a marine header assembly; an elongated cylindrical catalyst having opposing longitudinal ends, such catalyst adapted to be removably insertable into such cylindrical enclosure through the other open end of such enclosure, with one longitudinal end of such catalyst longitudinally seated against such circular inset bead; an annular ring for seating against the other longitudinal end of such catalyst; and a clamping ring removably received about such other open end of such enclosure, with such other open end of such enclosure adapted for engaging with an exhaust pipe seated thereagainst. With such an arrangement, such catalyst is removably clamped under compression within such enclosure, longitudinally trapped by such annular ring and such circular inset bead when such clamping ring is received about such enclosure.

Another exemplary embodiment in accordance with presently disclosed subject matter relates to an improved marine exhaust system for sealing an exhaust catalyst inside an enclosure while maintaining catalyst serviceability. Such subject matter preferably comprises a marine exhaust including respective header assembly and exhaust pipe components, such header assembly having a junction component thereof and such exhaust pipe having a flared region thereof; an enclosure having a pair of respective opposing open ends on opposite longitudinal ends thereof, for respective engagement with such marine header assembly and such exhaust pipe; an inset bead formed within one open end on such enclosure, with such one open end adapted for engaging with such junction component of such marine header assembly; an elongated catalyst having opposing longitudinal ends, such catalyst adapted to be removably insertable into such enclosure through the other open end of such enclosure, with one longitudinal end of such catalyst longitudinally seated against such inset bead; a ring for seating against the other longitudinal end of such catalyst; and a clamping ring removably received about such other open end of such enclosure, with such other open end of such enclosure adapted for engaging with such flared region of such exhaust pipe seated thereagainst. With such an arrangement, such catalyst is removably clamped under compression within such enclosure, longitudinally trapped by such annular ring and such circular inset bead when such clamping ring is received about such enclosure, to limit the amount of longitudinal movement of such catalyst in such enclosure as exhaust gases pass therethrough while permitting removal from such enclosure of such catalyst for servicing thereof.

Yet another exemplary embodiment in accordance with presently disclosed subject matter relates to a mount apparatus for removably receiving an exhaust catalyst in an exhaust system including respective header assembly and exhaust pipe components. Such subject matter preferably comprises an enclosure having respective opposing ends for respective engagement with a header assembly and an exhaust pipe on either end of such enclosure; a circular inset bead formed within one end on such enclosure; an exhaust catalyst having respective ends and adapted to be removably insertable into such cylindrical enclosure through the other end of such enclosure, with one end of such catalyst longitudinally seated against such circular inset bead; an annular ring for seating against the other end of such catalyst; and a clamping ring removably received about such enclosure, with both ends of such enclosure respectively engaged with an exhaust pipe and header assembly respectively. Per such arrangement, such catalyst is removably clamped within such enclosure, longitudinally trapped by such annular ring and such circular inset bead when such clamping ring is received about such enclosure.

Those of ordinary skill in the art, upon reading the entire disclosure herewith, should appreciate that the presently disclosed subject matter equally relates to and/or encompasses apparatus subject matter as well as corresponding and/or related methodology. One exemplary embodiment in accordance with presently disclosed subject matter relates to methodology for providing an improved marine exhaust system for sealing an exhaust catalyst inside an enclosure while maintaining catalyst serviceability. Such exemplary methodology preferably may comprise providing a marine exhaust including respective header assembly and exhaust pipe components, such header assembly having a junction component thereof and such exhaust pipe having a flared region thereof; providing an enclosure having a pair of respective opposing open ends on opposite longitudinal ends thereof, for respective engagement with such marine header assembly and such exhaust pipe; providing an inset bead formed within one open end on such enclosure; engaging such one open end of such enclosure with such junction component of such marine header assembly; providing an elongated catalyst having opposing longitudinal ends; removably inserting such catalyst into such enclosure through the other open end of such enclosure, until one longitudinal end of such catalyst is longitudinally seated against such inset bead; seating a ring against the other longitudinal end of such catalyst; engaging such other open end of such enclosure with such flared region of such exhaust pipe, with a clamping ring removably received about such other open end of such enclosure; and tightening such clamping ring around such enclosure. Per such methodology, such catalyst is removably clamped under compression within such enclosure, longitudinally trapped by such annular ring and such circular inset bead, to limit the amount of longitudinal movement of such catalyst in such enclosure as exhaust gases pass therethrough while permitting removal from such enclosure of such catalyst for servicing thereof.

Additional objects and advantages of the presently disclosed subject matter are set forth in, or will be apparent to those of ordinary skill in the art from, the detailed description herein. Also, it should be further appreciated that modifications and variations to the specifically illustrated, referenced, and discussed features, elements, and steps hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which.

Figure 1:
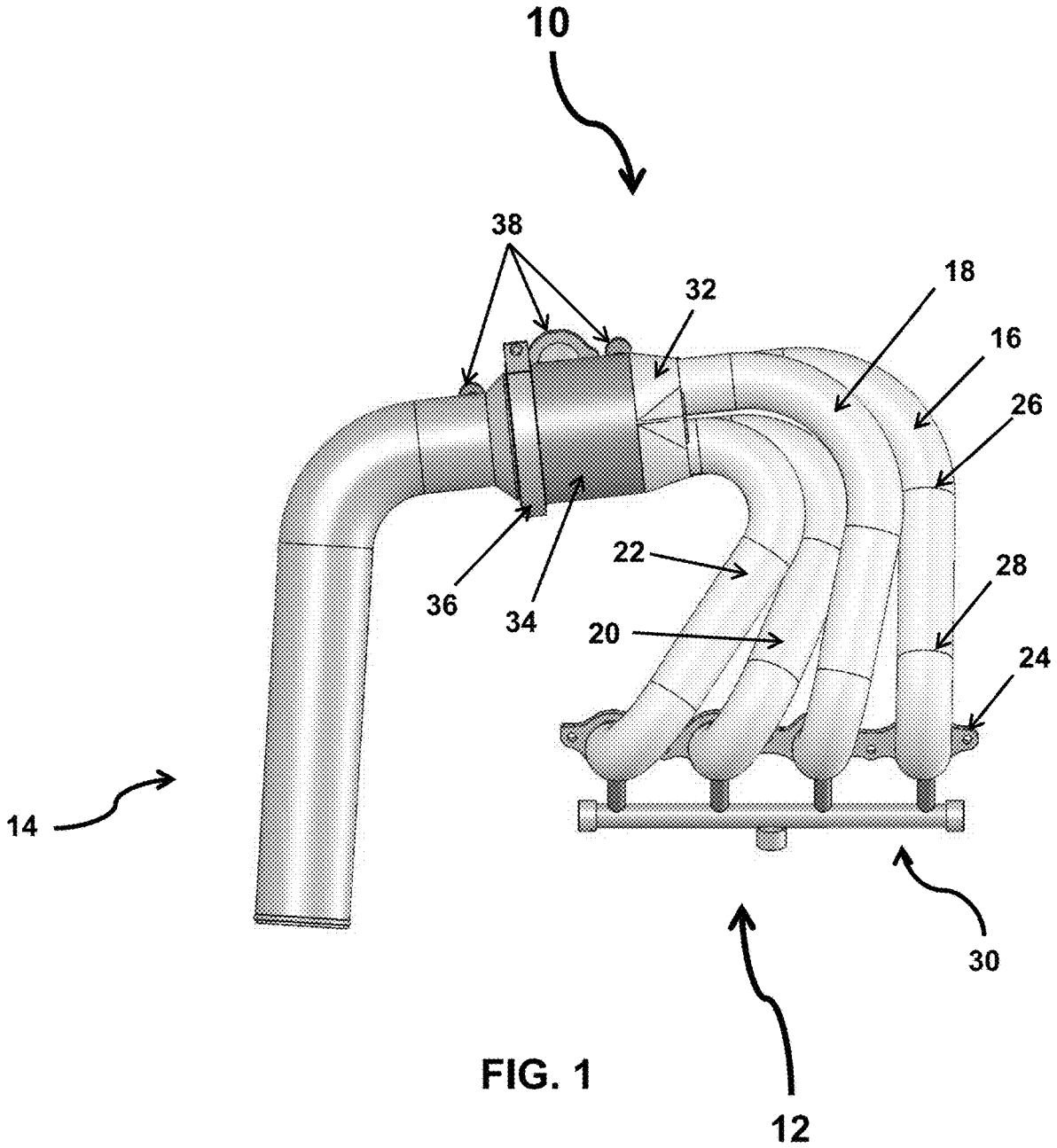
FIG. 1 illustrates a generally side elevation view of an exemplary embodiment of an assembled compression clamping exhaust catalyst incorporating presently disclosed subject matter.

Repeat use of reference characters throughout the present specification and appended drawings is intended to represent same or analogous features, elements, or steps of the presently disclosed subject matter.

DETAILED DESCRIPTION OF THE PREFERRED EMBODIMENTS

As discussed in the Summary of the Subject Matter section, the presently disclosed subject matter is generally concerned with apparatus and methodologies relating to improved exhaust systems and more particularly to the use of serviceable catalyst devices for use in marine exhaust systems.

Selected combinations of aspects of the presently disclosed technology correspond to a plurality of different embodiments of the presently disclosed subject matter. It should be noted that each of the exemplary embodiments presented and discussed herein should not insinuate limitations of the presently disclosed subject matter. Features or steps illustrated or described as part of one embodiment may be used in combination with aspects of one or more other embodiments to yield yet further embodiments. Additionally, certain features may be interchanged with similar devices or features not expressly mentioned which perform the same or similar function or functions.

Reference will now be made in detail to the presently preferred exemplary embodiments of the subject apparatus and associated and/or related methodology.

A generally side elevation view of an exemplary embodiment of an assembled compression clamping exhaust catalyst incorporating presently disclosed subject matter is shown by application FIG. 1. As understood by those of ordinary skill in the art without detailed explanation, a marine exhaust header system generally 10 includes a header assembly generally 12 which feeds into a mating exhaust pipe generally 14. Such header assembly 12 may include feeds from respective plurality of pipes, such as 16, 18, 20, and 22, which are outfitted with respective gaskets or in some instances a larger, unitary gasket generally 24. Such piping systems may generally be integral "single piece" type construction or may variously be multiple pieces joined together, as represented by marked joint lines 26 and 28. Also, different numbers of header elements may be involved in various embodiments, without otherwise affecting the broader disclosure herewith. Further, additional elements, such as representative pipe system generally 30 may be used for additional support and/or supplies of water in water-jacketed systems, as understood by those of ordinary skill in the art.

As shown, regardless of the number of header pipes involved, such pipes preferably converge at a junction area generally 32. Such junction area 32 further is engaged with an enclosure element 34 generally in accordance with presently disclosed subject matter. As shown, enclosure 34 serves as a transition for area 32 into the mating exhaust pipe 14, with details of such transition discussed herein in conjunction with other application Figures. A clamping ring generally 36 is used in part for effecting the joining of enclosure 34 with pipe 14, which in turn serves to mate header assembly 12 and its junction area 32 with representative exhaust pipe 14. Additional mounting elements or supports or other various interconnections generally 38 may be provided for particular implementations, with details thereof unnecessary for a complete understanding of the presently disclosed subject matter.

Figure 2:
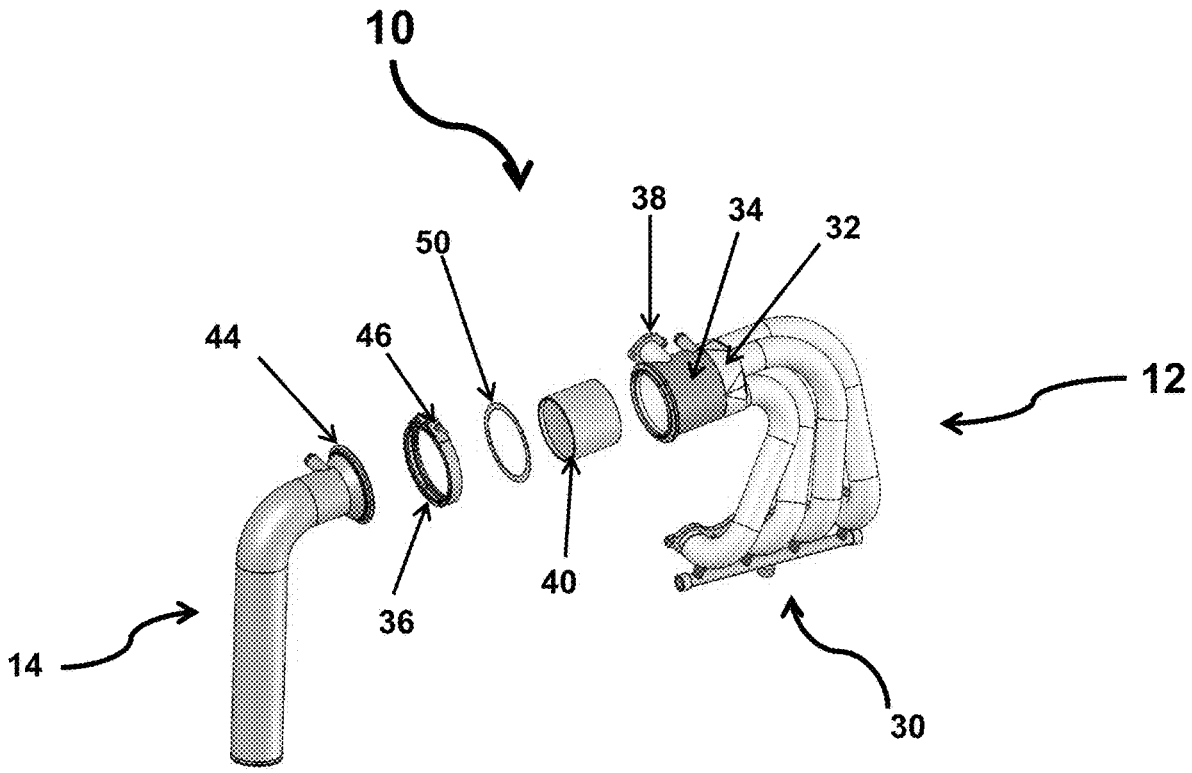
FIG. 2 illustrates a generally exploded view of the exemplary embodiment of a compression clamping assembly of application FIG. 1.

FIG. 2 illustrates a generally exploded view of the exemplary embodiment of a presently disclosed compression clamping assembly as represented by application FIG. 1. The subject matter of the representative figures herewith facilitates compression clamping and sealing of a serviceable exhaust catalyst inside an enclosure while still maintaining its serviceability. In particular, exemplary embodiments herewith ensure that the sealed but serviceable catalyst is maintained in a compression fit to limit the amount of its longitudinal movement in an associated enclosure.

As represented by application FIG. 2, a serviceable exhaust catalyst element generally 40 is used in association with a marine exhaust header system 10. The apparatus and corresponding methodology disclosed herewith disclose how such exhaust catalyst 40 is compression clamped and incorporated into the marine exhaust header system while still maintaining its serviceability.

Figure 3:
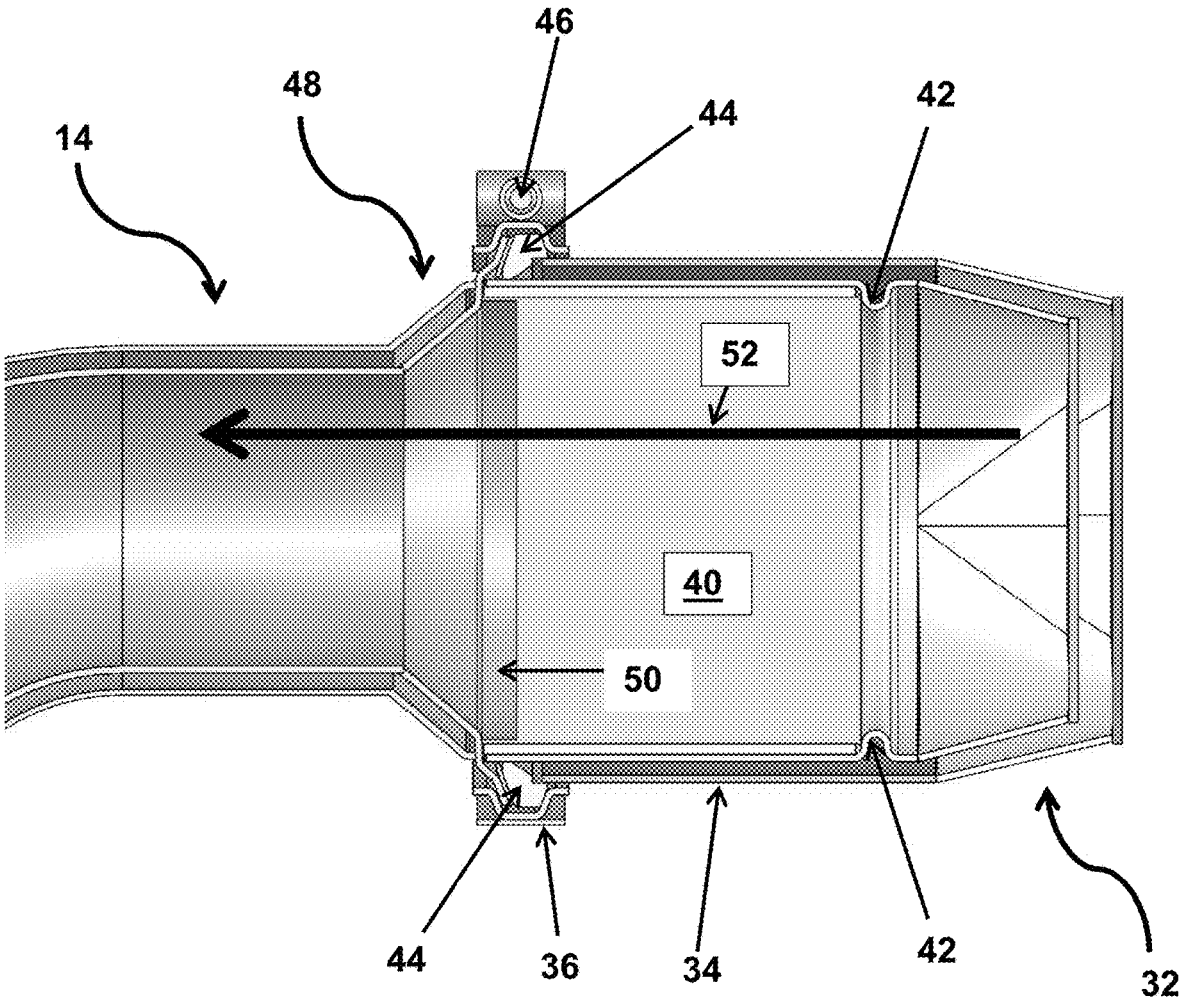
FIG. 3 illustrates an enlarged, longitudinal cross-section of an exemplary embodiment of the presently disclosed subject matter, fully assembled, corresponding with a portion of the exemplary components illustrated as fully exploded in application FIG. 2.
Figure 4:
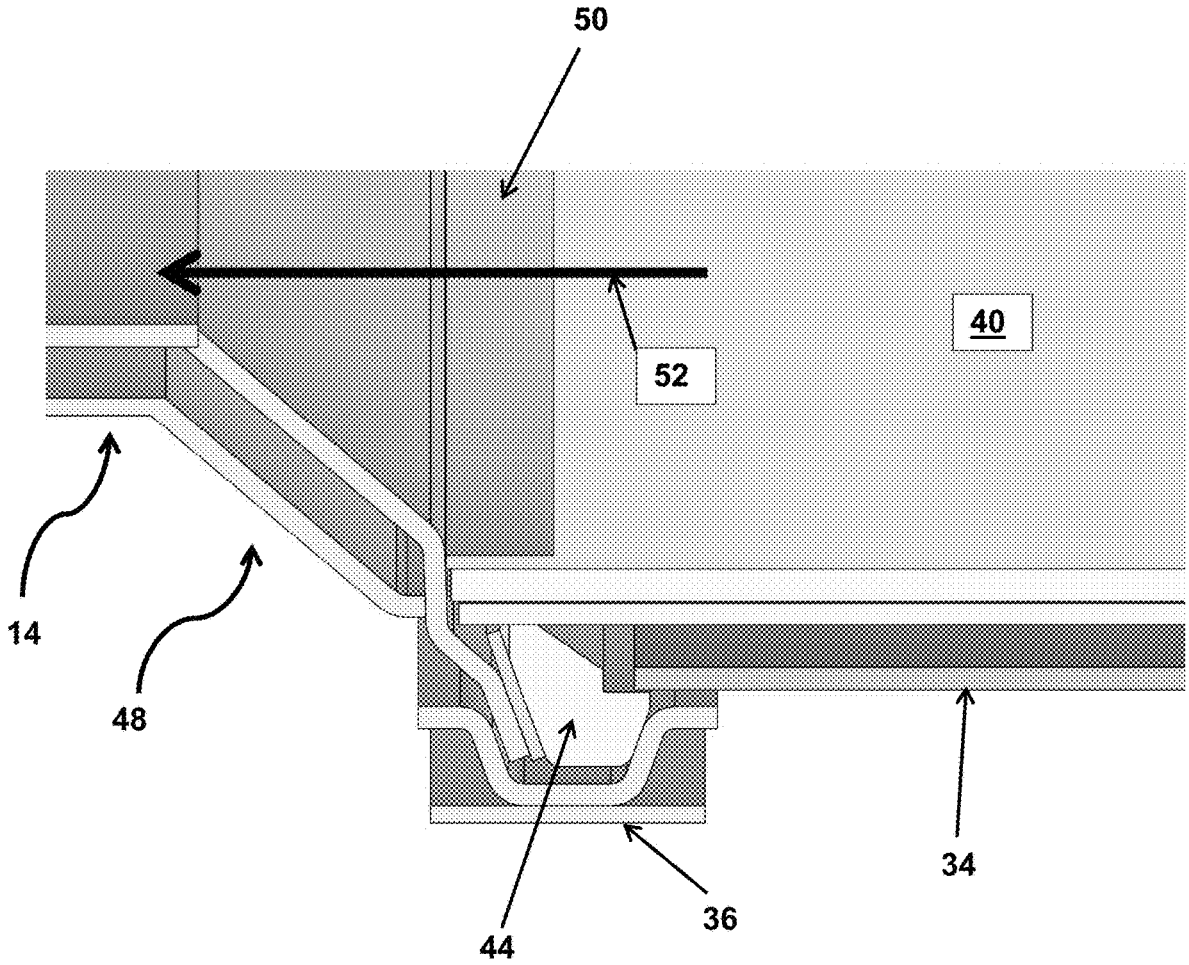
FIG. 4 comprises a further enlarged, longitudinal cross-section detail view of an exemplary embodiment of the presently disclosed subject matter, fully assembled, corresponding with a portion of the exemplary components illustrated as fully exploded in application FIG. 2.

FIG. 3 illustrates an enlarged, longitudinal cross-section of an exemplary embodiment of the presently disclosed subject matter, fully assembled, corresponding with a portion of the exemplary components illustrated as fully exploded in application FIG. 2. FIG. 4 comprises a further enlarged, longitudinal cross-section detail view of an exemplary embodiment of the presently disclosed subject matter, fully assembled, corresponding with a portion of the exemplary components illustrated as fully exploded in application FIG. 2.

Per the exemplary embodiment of exploded FIG. 2 and enlarged cross-section FIGS. 3 and 4, catalyst 40 is seated on an inset bead or ring 42 on the inside of enclosure 34. The clamping ring 36 cooperates with the enclosure 34 to clamp mating exhaust pipe generally 14, with a gasket generally 44 situated between the two. Clamping ring 36 may be tightened, for example, with use of a screw 46 or equivalent structures.

Other structures are provided to compress catalyst 40 in enclosure 34 as it is sealed. For example, mating exhaust pipe generally 14 may include a flared region generally 48 thereof in a manner to allow for movement along. A spherical ring generally 50 may also be provided, which also compresses catalyst 40 in enclosure 34 as clamping ring 36 is tightened, minimizing longitudinal movement of catalyst 40 (along the longitudinal length of enclosure 34). Such limiting of longitudinal movement is also with reference to the longitudinal direction of exhaust gases as they move along header assembly 12, through catalyst 40, and out exhaust pipe 14, generally in the direction of arrow 52.

As seated as illustrated, serviceable exhaust catalyst 40 is held into place with a compression fit to limit any longitudinal movement thereof either way along such direction (arrow 52) while still remaining accessible for servicing. In this instance, those of ordinary skill in the art will understand that servicing may involve reversing the compression mounting of catalyst 40 for its removal and replacement with a new element or for some other treatment thereof, such as cleaning, after which the catalyst element may be returned to its compression-fitted placement.

Throughout, repeat use of the same reference numbers as in other figures is intended to represent similar or same features or steps, with pertinent discussion applicable thereto. Also, the exemplary illustrations are intended as representative only, and variations in such arrangements, and uses of different materials or sizes of particular elements, while maintaining a compression-fitted, but serviceable mounting of an exhaust catalyst in the exhaust flow of a marine exhaust header system, are intended to come with the spirit and scope of the present disclosure.

While the presently disclosed subject matter has been described in detail with respect to specific embodiments thereof, it will be appreciated that those skilled in the art, upon attaining an understanding of the foregoing, may readily produce alterations to, variations of, and/or equivalents to such embodiments. Accordingly, the scope of the present disclosure is by way of example rather than by way of limitation, and the subject disclosure does not preclude inclusion of such modifications, variations, and/or additions to the presently disclosed subject matter as would be readily apparent to one of ordinary skill in the art.

What is claimed is:

1. Compression mount apparatus for an exhaust catalyst for a marine header, comprising:

a cylindrical enclosure having a pair of respective opposing open ends on opposite longitudinal ends thereof, for respective engagement with a marine header assembly and an exhaust pipe;

a circular inset bead formed within one open end on said enclosure, and having a smaller radius than said one open end, with said one open end adapted for engaging with a junction component of a marine header assembly;

an elongated cylindrical catalyst having opposing longitudinal ends, said catalyst adapted to be removably insertable into said cylindrical enclosure through the other open end of said enclosure, with one longitudinal end of said catalyst longitudinally seated against said circular inset bead;

an annular ring for seating against the other longitudinal end of said catalyst; and a clamping ring removably received about said other open end of said enclosure, with said other open end of said enclosure adapted for engaging with an exhaust pipe seated thereagainst, so that said catalyst is removably clamped under compression within said enclosure, longitudinally trapped by said annular ring and said circular inset bead when said clamping ring is received about said enclosure.

2. Compression mount apparatus as in claim 1, further comprising an exhaust pipe adapted for seating against said other open end of said enclosure, with said catalyst and said annular ring in place within said enclosure.

3. Compression mount apparatus as in claim 2, wherein:

said clamping ring further includes a tightening screw for selectively securing said clamping ring around said enclosure; and said exhaust pipe has a flared region for capturing said annular ring and compressing said catalyst by compressing said ring as said clamping ring is tightened with said tightening screw.

4. Compression mount apparatus as in claim 3, further comprising an annular gasket received between said enclosure and said exhaust pipe for sealing same as said clamping ring is tightened.

5. Compression mount apparatus as in claim 4, wherein said enclosure further includes a connection mounting element extending laterally therefrom.

6. An improved marine exhaust system for sealing an exhaust catalyst inside an enclosure while maintaining catalyst serviceability, comprising:

a marine exhaust including respective header assembly and exhaust pipe components, said header assembly having a junction component thereof and said exhaust pipe having a flared region thereof;

an enclosure having a pair of respective opposing open ends on opposite longitudinal ends thereof, for respective engagement with said marine header assembly and said exhaust pipe;

an inset bead formed within one open end on said enclosure, with said one open end adapted for engaging with said junction component of said marine header assembly;

an elongated catalyst having opposing longitudinal ends, said catalyst adapted to be removably insertable into said enclosure through the other open end of said enclosure, with one longitudinal end of said catalyst longitudinally seated against said inset bead;

a ring for seating against the other longitudinal end of said catalyst; and a clamping ring removably received about said other open end of said enclosure, with said other open end of said enclosure adapted for engaging with said flared region of said exhaust pipe seated thereagainst, so that said catalyst is removably clamped under compression within said enclosure, longitudinally trapped by said annular ring and said circular inset bead when said clamping ring is received about said enclosure, to limit the amount of longitudinal movement of said catalyst in said enclosure as exhaust gases pass therethrough while permitting removal from said enclosure of said catalyst for servicing thereof.

7. An improved marine exhaust system as in claim 6, wherein said enclosure and said catalyst are cylindrical.

8. An improved marine exhaust system as in claim 6, wherein:

said clamping ring further includes a tightening screw for selectively securing said clamping ring around said enclosure; and said improved marine exhaust system further comprises an annular gasket received between said enclosure and said exhaust pipe for sealing same as said clamping ring is tightened.

9. An improved marine exhaust system as in claim 6, wherein said header assembly includes feeds from a respective plurality of pipes, outfitted with respective gaskets.

10. An improved marine exhaust system as in claim 6, wherein said header assembly includes one of integral single piece type construction and multiple pieces joined together construction.

11. An improved marine exhaust system as in claim 6, wherein said header assembly includes a water-jacketed cooling system.

12. An improved marine exhaust system as in claim 6, wherein said enclosure further includes a connection mounting element extending laterally therefrom.

13. A mount apparatus for removably receiving an exhaust catalyst in an exhaust system including respective header assembly and exhaust pipe components, comprising:

an enclosure having respective opposing ends for respective engagement with a header assembly and an exhaust pipe on either end of said enclosure;

a circular inset bead formed within one end on said enclosure;

an exhaust catalyst having respective ends and adapted to be removably insertable into said cylindrical enclosure through the other end of said enclosure, with one end of said catalyst longitudinally seated against said circular inset bead;

an annular ring for seating against the other end of said catalyst; and a clamping ring removably received about said enclosure, with both ends of said enclosure respectively engaged with an exhaust pipe and header assembly respectively, so that said catalyst is removably clamped within said enclosure, longitudinally trapped by said annular ring and said circular inset bead when said clamping ring is received about said enclosure.

14. A mount apparatus as in claim 13, wherein:

said enclosure comprising a cylindrical enclosure having a pair of respective opposing open ends on opposite longitudinal ends thereof, for respective engagement with a marine header assembly and an exhaust pipe; and said circular inset bead is formed within one open end on said enclosure, and has a smaller radius than said one open end, with said one open end adapted for engaging with a junction component of a header assembly.

15. A mount apparatus as in claim 14, wherein:

said catalyst comprises an elongated cylindrical catalyst having opposing longitudinal ends; and said mount apparatus further comprises an exhaust pipe adapted for seating against said other open end of said enclosure, with said catalyst and said annular ring in place within said enclosure, so that said catalyst is removably clamped by said clamping ring under compression within said enclosure so as to limit the amount of longitudinal movement of said catalyst in said enclosure.

16. A mount apparatus as in claim 15, wherein:

said clamping ring further includes a tightening screw for selectively securing said clamping ring around said enclosure; and said exhaust pipe has a flared region for capturing said annular ring and compressing said catalyst by compressing said ring as said clamping ring is tightened with said tightening screw.

17. A mount apparatus as in claim 16, further comprising an annular gasket received between said enclosure and said exhaust pipe for sealing same as said clamping ring is tightened.

18. A method of providing an improved marine exhaust system for sealing an exhaust catalyst inside an enclosure while maintaining catalyst serviceability, comprising:

providing a marine exhaust including respective header assembly and exhaust pipe components, said header assembly having a junction component thereof and said exhaust pipe having a flared region thereof;

providing an enclosure having a pair of respective opposing open ends on opposite longitudinal ends thereof, for respective engagement with said marine header assembly and said exhaust pipe;

providing an inset bead formed within one open end on said enclosure;

engaging said one open end of said enclosure with said junction component of said marine header assembly;

providing an elongated catalyst having opposing longitudinal ends;

removably inserting said catalyst into said enclosure through the other open end of said enclosure, until one longitudinal end of said catalyst is longitudinally seated against said inset bead;

seating a ring against the other longitudinal end of said catalyst;

engaging said other open end of said enclosure with said flared region of said exhaust pipe, with a clamping ring removably received about said other open end of said enclosure; and tightening said clamping ring around said enclosure so that said catalyst is removably clamped under compression within said enclosure, longitudinally trapped by said annular ring and said circular inset bead, to limit the amount of longitudinal movement of said catalyst in said enclosure as exhaust gases pass therethrough while permitting removal from said enclosure of said catalyst for servicing thereof.

19. A method as set forth in claim 18 further comprising untightening said clamping ring and removing said catalyst from said enclosure, for replacement or cleaning of said catalyst.

20. A method as set forth in claim 18, wherein said enclosure and said catalyst are cylindrical.

21. A method as set forth in claim 18, wherein:

said clamping ring further includes a tightening screw for selectively securing said clamping ring around said enclosure; and said improved marine exhaust system further comprises an annular gasket received between said enclosure and said exhaust pipe for sealing same as said clamping ring is tightened.

22. A method as set forth in claim 18, wherein said header assembly includes feeds from a respective plurality of pipes, outfitted with respective gaskets.

23. A method as set forth in claim 18, wherein said header assembly is constructed of an integral single piece or is constructed of multiple pieces joined together.

24. A method as set forth in claim 18, wherein said header assembly includes a water-jacketed cooling system.

25. A method as set forth in claim 18, wherein said enclosure further includes a connection mounting element extending laterally therefrom.

* * * * *